US005370838A

United States Patent [19]

Sato et al.

[11] Patent Number: 5,370,838

[45] Date of Patent: Dec. 6, 1994

[54] FE-BASE SUPERALLOY

[75] Inventors: Koji Sato; Takehiro Ohno, both of Yasugi, Japan

[73] Assignee: Hitachi Metals, Ltd., Tokyo, Japan

[21] Appl. No.: 219,916

[22] Filed: Mar. 30, 1994

[30] Foreign Application Priority Data

Dec. 7, 1993 [JP] Japan ..... 5-339949
Feb. 4, 1994 [JP] Japan ..... 6-033068

[51] Int. Cl.[5] ..... C22C 38/44; C22C 38/50; C22C 38/48

[52] U.S. Cl. ..... 420/53; 420/586.1

[58] Field of Search ..... 420/53, 586.1

[56] References Cited

U.S. PATENT DOCUMENTS 4,165,997 8/1979 Smith, Jr. et al. ..... 420/53
4,377,553 5/1983 Korenko ..... 420/53

FOREIGN PATENT DOCUMENTS 56-20148 2/1981 Japan .
61-99659 5/1986 Japan ..... 420/53
62-93353 4/1987 Japan .
62-199752 9/1987 Japan .

*Primary Examiner*—Deborah Yee
*Attorney, Agent, or Firm*—Sughrue, Mion, Zinn, Macpeak & Seas

[57] ABSTRACT

An Fe-base superalloy essentially consisting of up to 0.20% C, up to 1.0% Si, up to 2.0% Mn, more than 25% and less than 30% Ni, 10 to 15% Cr, one or both of not less than 0.05% and less than 1.0% Mo and not less than 0.05% and less than 2.0% W so that an amount of Mo+0.5 W is not less than 0.05 and less than 1.0, 0.7 to 2.0% Al, 2.5 to 4.0% Ti, 0.05 to 1.0% Nb, and the balance being substantially Fe except impurities.

13 Claims, 4 Drawing Sheets

FE-BASE SUPERALLOY

BACKGROUND OF THE INVENTION

The present invention relates to an inexpensive $\gamma'$-precipitation strengthening Fe-base superalloy which is excellent in high-temperature strength and structural stability and used for heat resistant tools such as tools of hot extrusion presses and hot forging dies, engine valves, gas turbine engine parts, various kinds of coil or sheet springs, heat resistant bolts and so forth.

A $\gamma'$-precipitation strengthening Fe-base superalloy known as A286 (JIS SUH660) (hereinafter referred to as A286) is used in a wide field as an inexpensive heat resistant alloy which can be used in a high-temperature range up to about 600° C.

The composition of A286 is specified in JIS (Japanese Industrial Standard) as follows: up to 0.08% C (carbon), up to 1.0% Si, up to 2.0% Mn, up to 0.04% P, up to 0.03% S, 24.0 to 27.0% Ni, 13.5 to 16.0% Cr, 1.0 to 1.5% Mo, 0.10 to 0.50% V, up to 0.35% Al,1.90 to 2.35% Ti, 0.001 to 0.010% B (boron), and the balance of Fe.

On the other hand, improved alloys of A286 are proposed in JP-A-62-93353, JP-A-62-199752 and so forth. Further, an alloy of a broader composition range including A286 is proposed as an alloy for an exhaust engine valve in JP-A-56-20148.

However, for effective use of energy in consideration of the recent environmental problems, temperatures at which various kinds of heat resistant parts are used have been increased. For use in such a high temperature range, high-temperature strength of A286 is insufficient.

A286 is also used as various kinds of high-strength spring materials. For this use, however, when A286 is subjected to aging treatment after cold working, pseudo-stable $\gamma'$-phase which contributes to strengthening is transformed into stable $\eta$-phase, which results in a problem that a sufficient strength can not be obtained.

Moreover, any of the above-mentioned alloys proposed in JP-A-62-93353, JP-A-62-199752 and so forth as the improved alloys of A286 can not be said to have been sufficiently increased in strength as compared witch A286. Furthermore, although JP-A-56-20148 discloses the alloy including A286 for an exhaust engine valve which has a broader composition range, it is difficult to say that the alloy of JP '148 is considerably improved in strength as compared with A286 if Ni and Cr contents of the alloy are at about the same level as those of A286.

SUMMARY OF THE INVENTION

An objective of the present invention resides in providing a $\gamma'$-precipitation strengthening Fe-base superalloy having such a composition that the price is not drastically higher than that of A286, and that the room-temperature and high-temperature tensile strength, the high-temperature creep rupture strength and the structural stability while it is heated at high temperature are superior to those of A286.

Conventionally, in order to improve the strength for use in a temperature range to about 600° C. at the maximum, Fe-base superalloys having such compositions that the Ti/Al ratio is high, and that the alloy is precipitation strengthened with pseudo-stable $\gamma'$-phase ($Ni_3(Al, Ti)$: fcc, L12 structure), have been preferred (e.g., V57 and A286). Indeed, such a high Ti/Al ratio is advantageous for improving the tensile strength in a temperature range up to about 600° C., but when the application temperature reaches a temperature range of up to about 700° C., pseudo-stable $\gamma'$-phase is transformed into $\eta$-phase ($Ni_3Ti$: hcp, D024 structure), and the high-temperature strength is drastically decreased.

As a result of keen investigation, the inventors of the present application have selected an Ni-Cr-(Mo,W)-Al-Ti-Nb-Fe alloy system as the optimum alloy system and have found the optimum content of each component element. Also, in accordance with the following three methods, the inventors have invented a novel alloy which contains up to 30% Ni for saving the resources but satisfies the above-mentioned object.

a) Combination of Nb, Mo and W enables solid-solution strengthening of both $\gamma$-phase which is matrix and $\gamma'$-phase which is the precipitation strengthening phase. The optimum value of the sum of equivalent atomic weights of these three elements (Nb+Mo+0.5 W) has been found.

b) In $\gamma'$-phase composed of $Ni_3(Al,Ti,Nb)$, an amount of "1.8 Al+Ti+0.5Nb" converted from weight % to mol % is increased, to thereby enhance the strength. It corresponds to about $\frac{1}{4}$ of a precipitation amount of $\gamma'$-phase (volume %) although it is a rough presumption. By controlling this value within a range of 4.5 to 6.0, short-time tensile strength can be improved.

c) In $\gamma'$-phase composed of $Ni_3(Al,Ti,Nb)$, a ratio of 1.8 Al/(1.8 Al+Ti+0.5 Nb) converted from weight % to mol % is increased, to thereby stabilize $\gamma'$-phase (which leads to an increase in the amount of Al alone).

When the Al/Ti ratio is merely increased, it serves as an advantage to the structural stability. However, $\gamma'$-phase has a lattice constant close to the lattice constant of $\gamma$-phase which is the base phase, and does not fulfill coherent precipitation strengthening, thereby deteriorating the short-time tensile strength. Therefore, although the function partially overlaps the function of the foregoing method 1, a small amount of Nb is further added to obtain $\gamma'$-phase having a high coherent strain amount and high stability while suppressing transformation into $\eta$-phase composed of $Ni_3Ti$.

On the basis of these speculations, one or both of not less than 0.05% and less than 1.0% Mo and not less than 0.05% and less than 2.0% W are determined in such a range that an amount of "Mo+0.5 W" is not less than 0.05 and less than 1.0, and also, Nb content is determined as 0.05 to 1.0%. Further, when an amount of "Nb+Mo+0.5 W" is 0.55 to 1.6, the high-temperature rupture strength has the optimum value. In addition, Al content is determined as 0.7 to 2.0%, and a ratio of 1.8 Al/(1.8 Al+Ti+0.5 Nb) is determined in a range of 0.25 to 0.6. In relation to Nb, a ratio of 0.5 Nb/(Ti+0.5 Nb) is determined in a range of 0.02 to 0.15. With the optimum composition of these elements, it is possible to prevent precipitation of Laves phase and $\chi$-phase on long-time heating which has been a problem of the conventional Fe-base alloy, and to prevent a decrease in the high-temperature strength due to transformation from $\gamma'$phase into $\eta$-phase. Among conventional Fe-base superalloys containing less than 30% Ni and up to 15% Cr, none has had such combination of Nb and Mo and/or W, a high Al ratio, a high 1.8 Al/(1.8 Al+Ti+0.5 Nb) ratio, and a high 0.5 Nb/(Ti+0.5 Nb) ratio. Therefore, the invention alloy can be regarded as a really novel invention.

More specifically, according to the present invention, there is provided an Fe-base superalloy essentially consisting of, by weight, up to 0.20% C, up to 1.0% Si, up to 2.0% Mn, more than 25% and less than 30% Ni, 10to 15% Cr, one or both of not less than 0.05% and less than 1.0% Mo and not less than 0.05% and less than 2.0% W so that an amount of "Mo+0.5 W" is not less than 0.05 and less than 1.0, 0.7 to 2.0% Al, 2.5 to 4.0% Ti, 0.05 to 1.0% Nb, and the balance being substantially Fe except for impurities. Preferably, the invention alloy contains up to 0.15% C, up to 0.5% Si, up to 1.5% Mn, and not less than 10% and less than 13.5% Cr. More preferably, the invention superalloy essentially consists of, by weight, up to 0.10% C, up to 0.3% Si, up to 0.7% Mn, 25.5 to 28% Ni, not less than 12% and less than 13.5% Cr, one or both of 0.1 to 0.8% Mo and 0.1 to 1.6% W so that an amount of "Mo+0.5 W" is 0.2 to 0.8, 0.9 to 1.5% Al, 2.7 to 3.6% Ti, 0.2 to 0.7% Nb, and the balance being substantially Fe except for impurities.

Moreover, of the above-mentioned elements of the alloys, the relationships of Nb, Mo, W, Al and Ti expressed in the following relational formulas are preferably within predetermined ranges:

| Relational formula | Broader range | More preferable range |
|---|---|---|
| Value A = Nb + Mo + 0.5W | 0.55 to 1.6 | 0.7 to 1.35 |
| Value B = 1.8Al + Ti + 0.5Nb | 4.5 to 6.0 | 5.0 to 5.5 |
| Value C = 1.8Al/(1.8Al + Ti + 0.5Nb) | 0.25 to 0.60 | 0.35 to 0.45 |
| Value D = 0.5Nb/(Ti + 0.5Nb) | 0.02 to 0.15 | 0.04 to 0.13 |

Moreover, the invention alloy may optionally contain, one or more of up to 0.02% B, up to 0.2% Zr, up to 0.02% Mg, and up to 0.02% Ca.

DETAILED DESCRIPTION OF THE INVENTION

Reasons for determining components of the invention alloy will now be described.

Carbon combines with Ti and Nb and forms MC type carbides so as to prevent coarsening of crystal grains and to improve creep rupture ductility. Consequently, a small amount of carbon must be added. However, excessive addition over 0.15% causes decomposition reaction from MC carbides into $M_{23}C_6$ type carbides during long-time heating, thereby deteriorating grain-boundary ductility at normal temperature. Therefore, up to 0.15% C, preferably up to 0.10% C, is added.

Si and Mn are added to the invention alloy as deoxidizing elements. However, excessive addition of either of them results in a decrease in high-temperature strength. Therefore, Si is restricted to up to 1.0%, and Mn is restricted to up to 2.0%. Preferably, Si content is up to 0.5%, and Mn content is up to 1.5%. More preferably, Si content is up to 0.3%, and Mn content is up to 0.7%.

Ni stabilizes the austenite phase of matrix and also increases high-temperature strength. Further, Ni is an indispensable additive element as a $\gamma'$-phase constituting element. When Ni content is 25% or less, precipitation of $\gamma'$-phase becomes insufficient, thereby deteriorating high-temperature strength. On the other hand, when Ni content is 30% or more, the price of the alloy becomes unreasonably high even if the improvement effect of the property is taken into account. Since the price at the same level as A286 can not be maintained, Ni content is restricted to a range more than 25% and less than 30%. The preferable range of Ni is 25.5 to 28%.

Cr is an indispensable element for providing oxidation resistance for the alloy. In order to ensure the oxidation resistance as various kinds of heat resistant parts, 10% Cr is required at the minimum. However, if Cr content exceeds 15%, the structure becomes unstable, and harmful brittle phase such as $\alpha'$-phase or $\alpha$-phase rich in Cr is generated during long-time use at high temperature, thereby deteriorating creep rupture strength and normal-temperature ductility. Therefore, Cr is restricted to 10 to 15%. Preferable Cr content for maintaining oxidation resistance and increasing the structural stability is 12 to 13.5%. When the alloy having a composition with up to 27% Ni requires long-time structural stability especially for high-temperature use, Cr content is preferably 12 to 12.9%. Moreover, if Cr content is too high, adhesiveness of the lubricant coating when the alloy is used for bolts and the like is deteriorated, thereby degrading cold workability.

Mo and W are elements of the same group. Both of them serve for solid-solution strengthening of austenite matrix, and increase high-temperature creep rupture strength. In the present invention, Mo and W are combined with Nb (to be described later) which mainly serves for solid-solution strengthening of $\gamma'$-phase so as to obtain more excellent high-temperature properties than the conventional alloy. Consequently, one or both of not less than 0.05% Mo and not less than 0.05% W must be added. On the other hand, if Mo content is 1.0% or more and W content is 2.0% or more, intergranular brittle phase such as $\chi$-phase and Laves phase precipitate as a result of long-time heating. Therefore, Mo is restricted to a range not less than 0.05% and less than 1.0%, and W is restricted to a range not less than 0.05% and less than 2.0%. Moreover, since the sum of amounts of Mo and W calculated in terms of an atomic ratio produces substantially the same effect, an amount of "Mo+0.5 W" is restricted to a range not less than 0.05 and less than 1.0. Preferably, Mo content is 0.1 to 0.8%, W content is 0.1 to 1.6%, and the amount of "Mo+0.5 W" is 0.2 to 0.8. Moreover, in substantially the same manner as Cr, excessive addition of Mo and W deteriorates closeness of the lubricant coating, thereby degrading workability in producing bolts and the like.

Al is an indispensable element for causing precipitation of stable $\gamma'$-phase to obtain strength in a high temperature range of about 700° C., and Al also improves the oxidation resistance. Consequently, 0.7% Al is required at the minimum. However, if the Al content exceeds 2.0%, the hot workability is deteriorated. Therefore, Al is restricted to 0.7 to 2.0%. The preferable range of Al is 0.9 to 1.5%.

In the invention alloy, Ti combines with Ni as well as Al and Nb and causes precipitation of $\gamma'$-phase so as to increase high-temperature strength. Not less than 2.5% Ti must be added. However, if Ti content exceeds 4.0%, $\gamma'$-phase becomes unstable during long-time heating at high temperature, thus easily causing generation of $\eta$-phase and also degrading hot workability. Therefore, Ti is restricted to 2.5 to 4.0%. The preferable range of Ti is 2.7 to 3.6%.

In the invention alloy, Nb combines with Ni as well as Al and Ti and causes precipitation of $\gamma'$-phase so as to increase high-temperature strength. For this purpose, addition of 0.1% Nb is required at the minimum. The effect of Nb is superior to the effect of Ti, and Nb exhibits the most remarkable effect especially when it combines with Mo and/or W which mainly serve for solid-solution strengthening of $\gamma$-phase. However, Nb has a low solubility to Fe in matrix, and excessive addition of Nb over 1.0% results in an increase of a precipitation amount of Laves phase composed of $Fe_2Nb$ and a decrease in the ductility. Therefore, 0.05 to 1.0% Nb is added. The preferable Nb content is 0.2 to 0.8%. Further, Ta in the same group as Nb is an expensive element and is not an indispensable additive element of the invention alloy. However, since Ta produces an effect not lower than Nb in respect of strength, Ta can substitute Nb in the relationship of Nb=½ Ta.

In order to achieve the object of the present invention, Mo, W and Nb must satisfy the respective quantitative ranges described above, and also, the sum of atomic weights of these elements is very important. In a heat resistant alloy, Mo and W are the elements which cause solid-solution strengthening of γ-phase to the highest degree whereas Nb is one of the elements which cause solid-solution strengthening of γ'-phase to the highest degree. If only one of these two types of elements is added excessively, a difference is caused between degrees of solid-solution strengthening of the γ-phase and the γ'-phase. Consequently, the two types of elements must be added as uniformly as possible in terms of an atomic weight ratio. Moreover, if either of the two types is added excessively, Laves phase composed of $Fe_2(Nb,Mo,W)$ precipitates, thereby deteriorating the high-temperature strength and room-temperature ductility. Therefore, the preferable amount of "Nb+Mo+0.5 W" is 0.55 to 1.6. More preferably, it is 0.7 to 1.35. One of the most significant characteristics of the invention is that the optimum value for the foregoing combination of Nb and Mo and/or W has been found.

Moreover, Al, Ti and Nb must satisfy the respective quantitative ranges described above, and also, it is important to adjust the total amount of these elements as the γ' constituting elements and the ratio of Al in appropriate ranges.

As described above, it is important to adjust an amount of "1.8 Al+Ti+0.5 Nb" in relation to the precipitation amount of γ'-phase in an appropriate range. When this value is less than 4.5, high-temperature tensile strength becomes close to the level of A286, and when it exceeds 6.0, hot workability is deteriorated, thus decreasing the productivity. Therefore, the amount of 1.8 Al+Ti+0.5 Nb" is restricted to 4.5 to 6.0. The preferable amount of "1.8 Al+Ti+0.5 Nb" is 5.0 to 5.5.

Further, γ'-phase composed of Ni(Al,ti,Nb) can be stabilized by increasing a ratio of 1.8 Al/(1.8 Al+Ti+0.5 Nb) converted from weight % to mol %. If the ratio of 1.8 Al/(1.8 Al+Ti+0.5 Nb) is less than 0.25, high-temperature strength is liable to deteriorate due to transformation from γ'-phase to η-phase during long-time heating. On the other hand, if the ratio exceeds 0.60, solid-solution strengthening of γ'-phase is insufficient, thus deteriorating room-temperature strength. Therefore, the ratio of 1.8 Al/(1.8 Al+Ti+0.5 Nb) is preferably 0.25 to 0.60. More preferably, it is 0.35 to 0.45.

Addition of Nb leads to stabilization of γ'-phase and an increase in the coherent strain amount. Consequently, when a ratio of 0.5 Nb/(Ti+0.5 Nb) is less than 0.02, η-phase composed of $Ni_3Ti$ precipitates to thereby degrade the creep strength. On the other hand, when the value exceeds 0.15, excessive precipitation of Laves phase composed of $Fe_2Nb$ also causes degradation of creep strength. Therefore, the ratio of 0.5 Nb/(Ti+0.5 Nb) is restricted to 0.02 to 0.15. The preferable range is 0.04 to 0.13. One of the most significant characteristics of the invention is that a plurality of optimum values for the relationship of the foregoing γ'phase constituting elements have been found.

In the present invention, B (boron) and Zr are effective for increasing high-temperature strength and ductility due to the grain boundary strengthening function, and consequently, a proper amount of one or both of B and Zr can be added to the invention alloy. Their effect is produced from a small additive amount. However, if B content exceeds 0.02% and Zr content exceeds 0.2%, an early melting temperature during heating is decreased, thus deteriorating the hot workability. Therefore, upper limits of B and Zr are respectively 0.02% and 0.2%.

Mg and Ca enhance the quality of the alloy as strong deoxidizing/desulfurizing elements and also improve the ductility during high-temperature tension, creep deformation or hot working. Consequently, a proper amount of one or both of Mg and Ca can be added. Their effect is produced from a small additive amount. However, if Mg content exceeds 0.02% and Ca content exceeds 0.02%, an early melting temperature during heating is decreased, thus deteriorating hot workability. Therefore, upper limits of Mg and Ca are 0.02%.

Fe is an effective element for forming inexpensive austenite matrix of an alloy for effectively utilizing the resources, and consequently, Fe is determined as the balance of the alloy except unavoidable impurities.

Moreover, the invention alloy may contain other elements so long as their amounts are in the following ranges.

| | Broader range | More preferable range |
|---|---|---|
| P: | ≦0.04% | ≦0.01% |
| S: | ≦0.03% | ≦0.004% |
| O: | ≦0.02% | ≦0.005% |
| N: | ≦0.03% | ≦0.005% |
| Hf: | ≦0.20% | ≦0.10% |
| V: | ≦0.05% | |
| Y: | ≦0.1% | |
| REM: | ≦0.1% | |

Ingots of the above-described Fe-base superalloy are obtained through vacuum melting alone or the refining process such as electroslag remelting and vacuum arc remelting after vacuum melting. The ingots are subjected to the working process such as hot forging and hot rolling, and finished as primary products.

These materials are provided for practical use after they are subjected to solid solution heat treatment at 850° to 1100° C. and aging treatment at 600° to 850° C. to which γ'-precipitation strengthening superalloys are generally subjected. When they are used as materials of springs or the like which require high tensile strength, cold working of several % to several ten % is additionally conducted between the solid solution heat treatment and the aging treatment so that favorable properties are obtained in a relatively low temperature range to about 500° C.

When the invention alloy is used for heat resistant bolts, there can be obtained a high efficiency in cold heading and thread rolling as the bolts, and a relaxation property in the form of heat resistant bolts (a phenomenon that when the strain is kept constant after a predetermined stress is applied at high temperature, the stress is decreased as time elapses, which is one kind of creep property) which is more excellent than that of A286.

EXAMPLE 1

Figure 1:
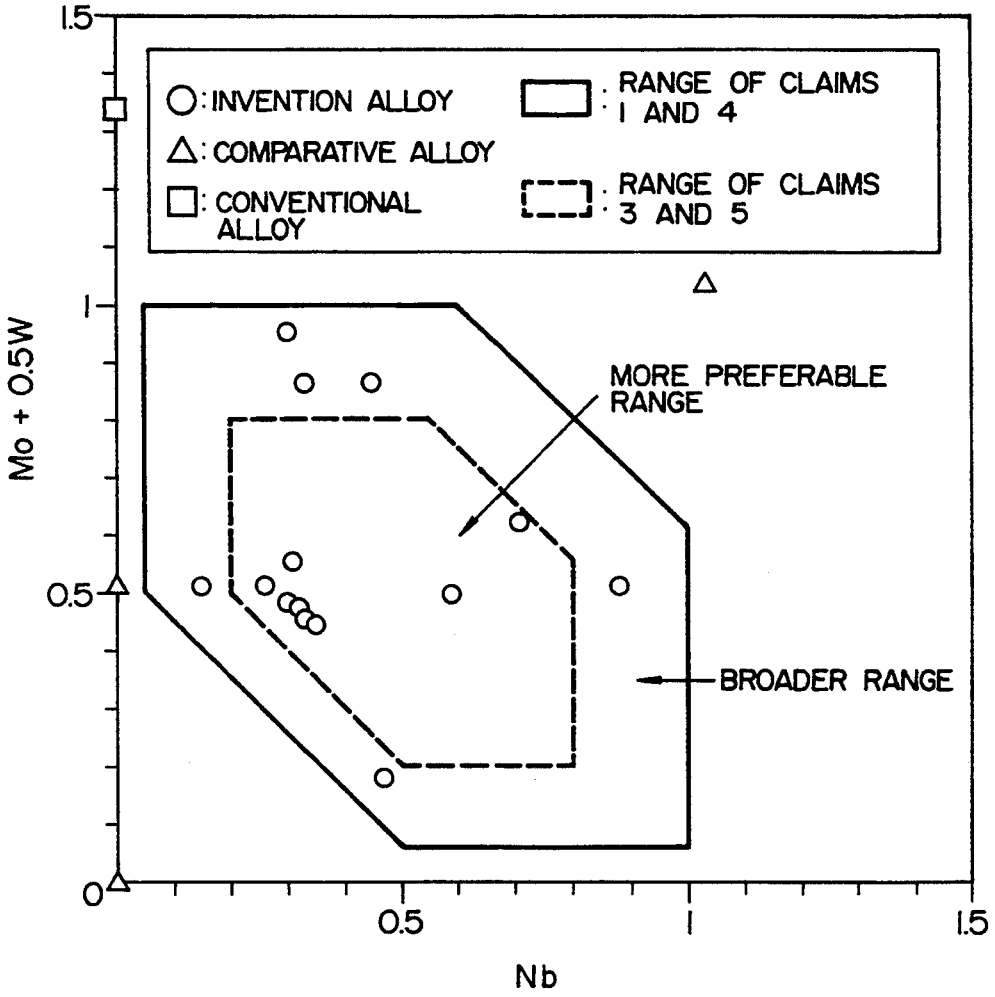
FIG. 1 is a graph illustrative of the relationship between "Mo+0.5 W" and Nb according to claims 1 and 4, and claims 3 and 5.

As for alloys having compositions shown in Table 1 except an invention alloy No. 14 and a conventional alloy No. 31, ingots of 10 kg were melted by vacuum induction melting and cast, and formed into bars having a cross section of 30 mm square by hot working. The bars were subjected to solid solution heat treatment at 980° C. for one hour followed by air cooling, and aging treatment at 720° C. for 16 hours followed by air cooling. After this standard aging or after overaging treatment at 800° C. for 200 hours, tension tests at room temperature and 700° C. and creep rupture tests under the condition of 700° C.–392 N/mm$^2$ were conducted.

The tension tests and creep rupture tests were carried out on the basis of the ASTM method. Results of the tests are shown in Table 2.

TABLE 1

| | | CHEMICAL COMPOSITION (wt %) | | | | | | | | | | | | | | |
|---|---|---|---|---|---|---|---|---|---|---|---|---|---|---|---|---|
| | No. | C | Si | Mn | Ni | Cr | Mo | W | Al | Ti | Nb | Fe | B | Zr | Mg | Ca |
| INVENTION ALLOY | 1 | 0.04 | 0.11 | 0.10 | 26.3 | 13.1 | 0.48 | — | 1.19 | 3.17 | 0.30 | Bal. | 0.0041 | — | 0.0006 | — |
| | 2 | 0.04 | 0.11 | 0.09 | 26.0 | 13.2 | 0.95 | — | 1.20 | 3.08 | 0.30 | Bal. | 0.0043 | — | — | — |
| | 3 | 0.04 | 0.11 | 0.09 | 26.2 | 13.3 | 0.49 | — | 1.25 | 2.85 | 0.59 | Bal. | 0.0039 | — | — | — |
| | 4 | 0.05 | 0.10 | 0.08 | 26.1 | 13.2 | 0.50 | — | 1.27 | 2.68 | 0.88 | Bal. | 0.0040 | — | 0.0009 | — |
| | 5 | 0.04 | 0.11 | 0.08 | 29.0 | 13.3 | 0.47 | — | 1.25 | 3.02 | 0.32 | Bal. | — | — | — | — |
| | 6 | 0.05 | 0.23 | 0.73 | 27.5 | 14.1 | — | 0.90 | 1.70 | 2.70 | 0.33 | Bal. | — | 0.06 | — | — |
| | 7 | 0.11 | 0.15 | 1.45 | 29.5 | 14.8 | 0.25 | 0.73 | 0.81 | 3.50 | 0.71 | Bal. | — | — | — | 0.0058 |
| | 8 | 0.05 | 0.08 | 0.15 | 26.3 | 13.2 | 0.51 | — | 1.18 | 3.11 | 0.15 | Bal. | 0.0040 | — | 0.0155 | — |
| | 9 | 0.07 | 0.42 | 0.23 | 26.8 | 10.8 | — | 1.71 | 1.23 | 3.31 | 0.45 | Bal. | 0.0152 | 0.01 | 0.0010 | 0.0123 |
| | 10 | 0.02 | 0.13 | 0.12 | 27.8 | 13.9 | 0.72 | 0.28 | 0.93 | 2.85 | 0.33 | Bal. | — | 0.13 | 0.0056 | — |
| | 11 | 0.04 | 0.11 | 0.24 | 25.3 | 13.2 | — | 0.35 | 1.24 | 3.33 | 0.47 | Bal. | — | — | — | — |
| | 12 | 0.05 | 0.14 | 1.03 | 28.8 | 13.3 | 0.55 | — | 1.27 | 3.68 | 0.31 | Bal. | — | — | — | — |
| | 13 | 0.04 | 0.11 | 0.23 | 26.1 | 13.3 | 0.44 | — | 1.18 | 3.05 | 0.35 | Bal. | — | — | 0.0048 | — |
| | 14 | 0.04 | 0.01 | 0.01 | 26.2 | 13.2 | 0.51 | — | 1.21 | 3.11 | 0.26 | Bal. | 0.0042 | — | 0.0020 | — |
| COMPARATIVE ALLOY | 21 | 0.04 | 0.11 | 0.10 | 26.2 | 13.4 | 0.51 | — | 1.22 | 3.11 | — | Bal. | 0.0042 | — | 0.0015 | — |
| | 22 | 0.06 | 0.21 | 0.56 | 25.6 | 14.0 | — | — | 1.20 | 3.45 | — | Bal. | — | — | — | — |
| | 23 | 0.04 | 0.81 | 0.48 | 26.2 | 13.2 | — | 2.05 | 0.62 | 2.45 | 1.03 | Bal. | 0.0065 | — | — | — |
| CONVENTIONAL ALLOY | 31 | 0.04 | 0.20 | 0.10 | 25.3 | 14.7 | 1.34 | — | 0.28 | 2.15 | — | Bal. | 0.0039 | — | 0.0002 | V:0.29 |

| | No. | Mo+ 0.5W | VALUE A | VALUE B | VALUE C | VALUE D |
|---|---|---|---|---|---|---|
| INVENTION ALLOY | 1 | 0.48 | 0.78 | 5.46 | 0.39 | 0.045 |
| | 2 | 0.95 | 1.25 | 5.39 | 0.40 | 0.046 |
| | 3 | 0.49 | 1.08 | 5.40 | 0.42 | 0.094 |
| | 4 | 0.50 | 1.38 | 5.41 | 0.42 | 0.141 |
| | 5 | 0.47 | 0.79 | 5.43 | 0.41 | 0.050 |
| | 6 | 0.45 | 0.78 | 5.93 | 0.52 | 0.058 |
| | 7 | 0.62 | 1.33 | 5.31 | 0.27 | 0.092 |
| | 8 | 0.51 | 0.66 | 5.31 | 0.40 | 0.024 |
| | 9 | 0.86 | 1.31 | 5.75 | 0.39 | 0.064 |
| | 10 | 0.86 | 1.19 | 4.69 | 0.36 | 0.055 |
| | 11 | 0.18 | 0.65 | 5.80 | 0.39 | 0.066 |
| | 12 | 0.55 | 0.86 | 6.12 | 0.37 | 0.040 |
| | 13 | 0.44 | 0.79 | 5.35 | 0.40 | 0.054 |
| | 14 | 0.51 | 0.77 | 5.42 | 0.40 | 0.040 |
| COMPARATIVE ALLOY | 21 | 0.51 | 0.51 | 5.31 | 0.41 | 0.000 |
| | 22 | 0.00 | 0.00 | 5.61 | 0.39 | 0.000 |
| | 23 | 1.03 | 2.06 | 4.08 | 0.27 | 0.174 |
| CONVENTIONAL ALLOY | 31 | 1.34 | 1.34 | 2.65 | 0.19 | 0.000 |

VALUE A = Nb + 0.5W
VALUE B = 1.81Al + Ti + 0.5Nb
VALUE C = 1.8A/(1.8Al + Ti + 0.5Nb)
VALUE D = 0.5N/(Ti + 0.5Nb)

TABLE 2

| | No. | TENSILE STRENGTH ($N/mm^2$) ROOM TEMPERATURE STANDARD AGING | ROOM TEMPERATURE OVERAGING | 700° C. STANDARD AGING | 700° C. OVERAGING | CREEP RUPTURE PROPERTY LIFE (h) | REDUCTION OF AREA (%) |
|---|---|---|---|---|---|---|---|
| INVENTION ALLOY | 1 | 1185 | 1079 | 814 | 599 | 154.5 | 18.6 |
| | 2 | 1198 | 1074 | 816 | 599 | 117.2 | 56.1 |
| | 3 | 1194 | 1064 | 816 | 602 | 146.1 | 56.0 |
| | 4 | 1219 | 1067 | 821 | 597 | 93.4 | 57.4 |
| | 5 | 1208 | 1103 | 850 | 608 | 154.2 | 14.0 |
| | 6 | 1230 | 1130 | 843 | 625 | 160.3 | 12.3 |
| | 7 | 1230 | 1070 | 815 | 585 | 95.6 | 58.1 |
| | 8 | 1180 | 1066 | 801 | 588 | 82.0 | 14.9 |
| | 9 | 1260 | 1155 | 860 | 615 | 180.3 | 10.1 |
| | 10 | 1102 | 1052 | 798 | 580 | 89.8 | 50.3 |
| | 11 | 1190 | 1085 | 825 | 610 | 161.1 | 20.4 |
| | 12 | 1280 | 1140 | 880 | 620 | 177.9 | 8.9 |
| | 13 | 1188 | 1082 | 820 | 605 | 160.4 | 25.1 |
| COMPARATIVE ALLOY | 21 | 1172 | 1043 | 793 | 571 | 29.3 | 5.6 |
| | 22 | 1160 | 1027 | 750 | 540 | 32.1 | 7.9 |
| | 23 | 1140 | 980 | 756 | 500 | 20.5 | 26.4 |

In Table 1, Nos. 1 to 14 are invention alloys, Nos. 21 to 23 are comparative alloys, and No. 31 is a conventional alloy A286. The invention alloy No. 14 and the conventional alloy No. 31 were used in Examples 2 and 3. Amounts of "Mo+0.5 W" and values A, B, C and D are shown in Table 1 in addition to the various chemical compositions. The values A, B, C and D are an amount of "Nb+Mo+0.5 W", an amount of "1.8 Al+Ti+0.5 Nb", a ratio of 1.8 Al/(1.8 Al+Ti+0.5 Nb) and a ratio of 0.5 Nb/(Ti+0.5 Nb), respectively. As for the additive amounts of Nb and Mo, and/or W which are the most significant characteristic of the present invention, FIG. 1 shows values of all the alloys employed for Example 1, a broader range according to claims 1 and 4 and a more preferable range according to claims 3 and 5. The comparative alloy No. 22 is an alloy equivalent to a sample No. 1 in the first table of examples disclosed in JP-A-56-20148, and the comparative alloy No. 23 is an alloy melted and cast with a composition similar to a sample No. 5 in the first table of examples disclosed in the same JP-A-56-20148, in which additive amounts of Ni and Cr are only changed to the ranges of the invention alloys.

As understood from Table 2 and Table 3 which will be described later, room-temperature and 700° C. tensile strengths of the invention alloys after standard aging and overaging are higher than those of all the comparative and conventional alloys except for the room-temperature tensile strength of No. 10 after standard aging. Further, the invention alloys exhibit excellent rupture lives especially in the creep rupture property under the condition of 700° C.-392 $N/mm^2$.

Figure 2:
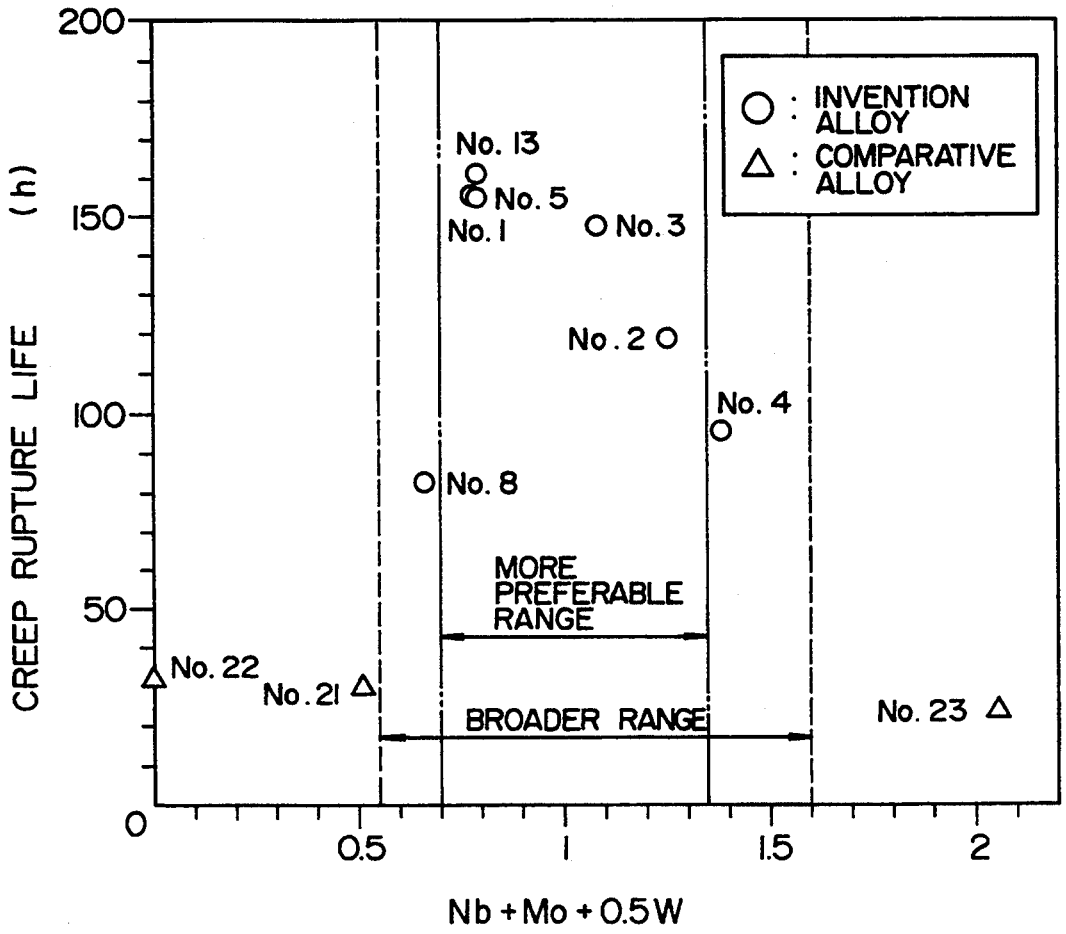
FIG. 2 is a graph illustrative of the relationship between the amount of "Nb+Mo+0.5 W" and the creep rupture duration of invention alloys and comparative alloys.

FIG. 2 illustrates the influence of the value A on the creep rupture strength which is the most significant characteristic of the invention. In the drawing, only the values A of the invention alloys whose values B are 5.3 to 5.5 and substantially constant and whose values C are 0.39 to 0.42 and substantially constant in Table 1 are selectively shown, but this is not the case with the comparative alloys. As understood from FIG. 2, optimum values obviously exist among the values A in the invention range, and one aspect of the novelty of the invention alloys can be observed.

Figure 3:
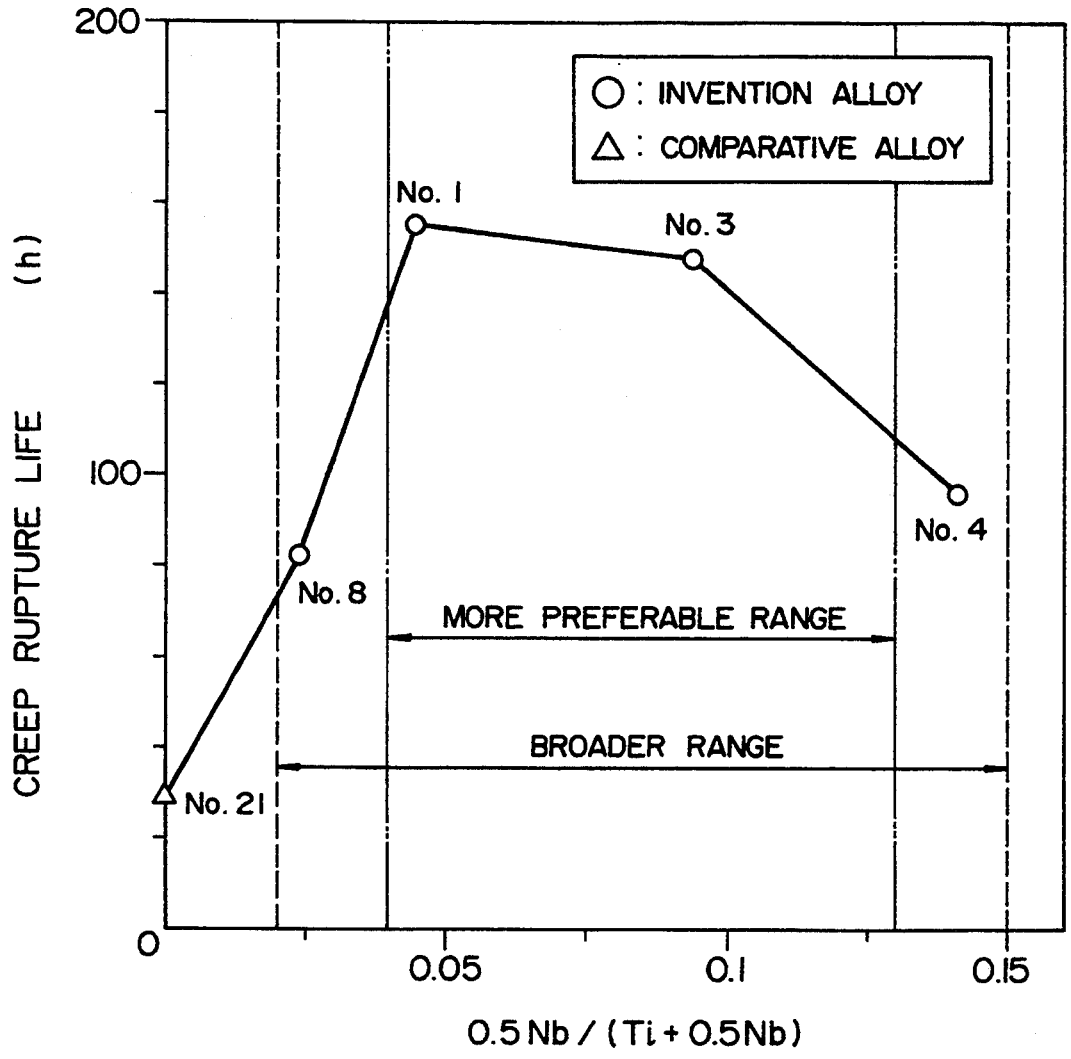
FIG. 3 is a graph illustrative of the relationship between the ratio of 0.5 Nb/(Ti+0.5 Nb) and the creep rupture duration of invention alloys and comparative alloys.

The comparative alloy No. 21 is an alloy obtained by adding no Nb to an invention alloy, and has a much lower creep rupture life than the invention alloys. Components of the invention alloys Nos. 1, 3, 4 and 8 and the comparative alloy No. 21 have substantially constant values except Ti, Nb and values D, and consequently, influences of Ti and Nb can be clearly understood (Although the values A vary, Mo content is constant in such cases, and variation in the values A is all caused by Nb). FIG. 3 illustrates the influence of the values D of these alloys on the creep rupture Life. As understood from FIG. 3, optimum values obviously exist also among the values D in the invention range.

Figure 4A:
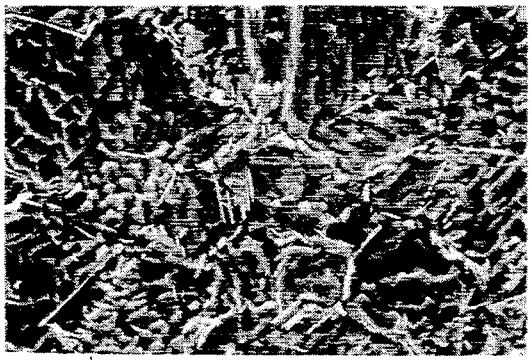
FIGS. 4*a* to 4*c* are photographs of metal structures, showing the structures of invention alloys and a comparative alloy after overaging which were observed by a scanning-type electron microscope.
Figure 4B:
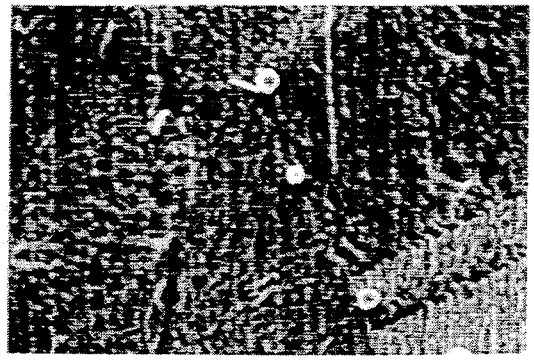
Figure 4C:
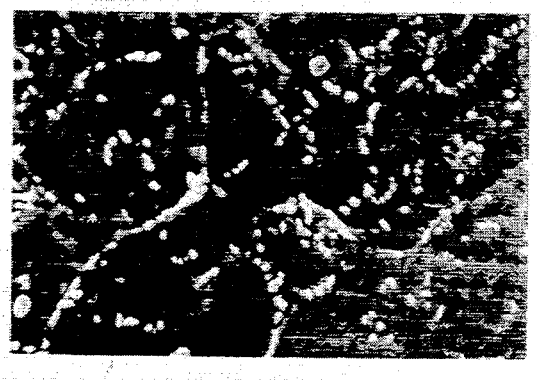

Of these alloys, microstructures of Nos. 21, 1 and 4 after overaging which were observed by a scanning-type electron microscope are shown in FIGS. 4*a* to 4*c*. Referring to FIG. 3, as the value D is lower, the rupture life is decreased due to precipitation of $\eta$-phase composed of $Ni_3Ti$, as shown in FIG. 4*a*. On the other hand, as the value D is higher, the rupture life is decreased because precipitation of Laves phase composed of $Fe_2Nb$ tends to increase, as shown in FIG. 4*c*. In contrast, other phases than $\gamma$-phase which is the base phase and $\gamma'$-phase which is a precipitation strengthening phase, can hardly be found in the invention alloy No. 1 shown in FIG. 4*b* even after overaging, and one reason for high life is obviously the excellent structural stability.

Such control of the Nb/Ti ratio to the optimum value is a fact which has been disclosed by this invention for the first time. From this point of view, it can be understood that the present invention is a novel invention.

Moreover, it is obviously understood from the foregoing results that optimum values also exist among the values B and C in the ranges according to the invention.

The comparative alloy No. 22 is an alloy obtained by adding no Nb, Mo and W to an invention alloy, and has a lower strength than the invention alloys and the comparative alloy No. 21. It is obviously understood from this fact that Mo and W are also effective elements for improving the high-temperature strength in the invention. Further, the comparative alloy No. 23 has high additive amounts of W and Nb, and its values A, B and D are out of the invention ranges. With the additive amounts of Ni and Cr according to the invention, the comparative alloy No. 23 is obviously inferior to the invention alloys in respect of the high-temperature strength and structural stability.

EXAMPLE 2

Trial mass production of the invention alloy was carried out, and its properties were compared with those of the conventional alloy. Mass-production ingots of the invention alloy No. 14 and the conventional alloy No. 31 (A286) were melted by vacuum induction melting and cast, and formed into coils having a diameter of 8.5 mm by hot working and hot rolling. The chemical compositions of the two alloys are shown in Table 1. Thereafter, the coils were subjected to solid solution heat treatment at 980° C. for one hour followed by air cooling, and they were further subjected to drawing working at a reduction of several % to form them into bars. Then, the same standard aging treatment as Example 1 and the overaging treatment after that were conducted, and room- and high-temperature strength properties in the respective aging states were evaluated in the same manner as Example 1. Table 3 shows results of the tests.

TABLE 3

| TEST ITEM | | TEST CONDITION | HEAT TREATMENT | INVENTION ALLOY No. 14 | CONVENTIONAL ALLOY No. 31 |
|---|---|---|---|---|---|
| TENSILE PROPERTY | TENSILE STRENGTH ($N/mm^2$) | ROOM TEMPERATURE | STANDARD AGING | 1373 | 1223 |
| | | | OVERAGING | 1171 | 838 |
| | | 700° C. | STANDARD AGING | 997 | 809 |
| | | | OVERAGING | 666 | 448 |
| | REDUCTION OF AREA (%) | ROOM TEMPERATURE | STANDARD AGING | 41.8 | 48.5 |
| | | | OVERAGING | 46.9 | 43.7 |
| | | 700° C. | STANDARD AGING | 15.0 | 59.7 |
| | | | OVERAGING | 54.3 | 71.7 |
| CREEP RUPTURE PROPERTY (700° C.) | LIFE (h) | 441 $N/mm^2$ | STANDARD AGING | 46.0 | 19.1 |
| | | 392 $N/mm^2$ | STANDARD AGING | 244.7 | 68.4 |
| | | 343 $N/mm^2$ | STANDARD AGING | 763.6 | 115.4 |
| | REDUCTION OF AREA (%) | 441 $N/mm^2$ | STANDARD AGING | 21.3 | 44.2 |
| | | 392 $N/mm^2$ | STANDARD AGING | 22.6 | 43.5 |
| | | 343 $N/mm^2$ | STANDARD AGING | 23.4 | 41.7 |

AS understood from Table 3, since the invention alloy No. 14 having substantially the same composition as No. 1 was subjected to cold working of several % before aging, No. 14 had a higher strength than No. 1 due to the effect of strain aging. As compared with No. 31, a higher strength was obtained in any condition, and the 700° C. tensile strength after overaging was 1.5 times higher. As for creep rupture lives, the life of No. 14 was 2.4 times higher under a stress of 441 $N/mm^2$ and 6.6 times higher under a stress of 343 $N/mm^2$. Long life in the case of high stress is mainly due to the effect of combination of Nb and Mo expressed by the value A and the effect of an increase in the amount of $\gamma'$ expressed by the value B in Table 1. Moreover, long life in the case of low stress is mainly due to control of the values C and D in the optimum ranges.

The reduction of area of No. 14 at the time of high-temperature tension and creep rupture after standard aging was lower than that of No. 31, but No. 14 exhibited a sufficient value as a material of high-temperature strength. Even after overaging, the reduction of area after the room-temperature tension test was substantially equal to that of the normal aging material, and the reduction of area after the 700° C. tensile test was increased by a large degree. Such changes in the properties indicate that the invention alloy is suitable as a high-temperature structure material.

Figure 5A:
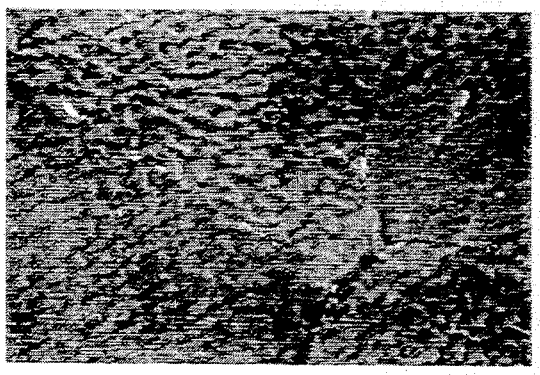
FIGS. 5*a* and 5*b* are photographs of metal structures, showing the structures of an invention alloy and a conventional alloy after overaging which were observed by a scanning-type electron microscope.
Figure 5B:
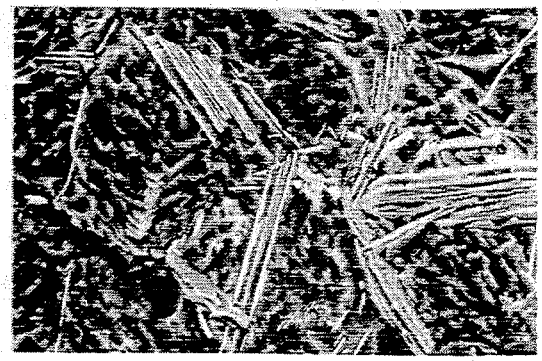

FIGS. 5*a* and 5*b* show structures after overaging which were observed by a scanning-type electron microscope. As shown in FIG. 5*b*, a large amount of $\eta$-phase is precipitated in the conventional alloy as a result of overaging whereas the invention alloy exhibits a favorable micro-structure in FIG. 5*a*.

EXAMPLE 3

Strength properties after cold high-reduction rolling and aging were evaluated for application as materials of springs and the like where high strength was required. The materials of the invention alloy No. 14 and the conventional alloy No. 31 which had been subjected to the cold drawing in Example 2 were worked into rod-like test pieces having a diameter of 6 mm and a length of 10 mm. 50% upsetting compression working of the test pieces was performed at room temperature, and they were further subjected to aging treatment at 720° C. for 16 hours followed by air cooling. By measuring hardness at the center of cross section of the test pieces at each stage, suitability as a spring material was determined. Hardness tests were performed at the load of 98N by means of a Vickers hardness meter. Results of the tests are shown in Table 4.

TABLE 4

| | | INVENTION ALLOY No. 14 | CONVENTIONAL ALLOY No. 31 |
|---|---|---|---|
| HARDNESS (HV98N) | BEFORE WORKING | 183 | 187 |
| | AFTER COLD WORKING | 369 | 348 |
| | COLD WORKING AND AGING | 483 | 387 |

AS understood from Table 4, although hardnesses of Nos. 14 and 31 before working and after cold working were substantially the same, the hardness of No. 14 was largely increased after aging whereas the hardness of No. 31 was increased slightly. This is presumably because a high degree of working strain causes $\eta$-phase to precipitate in the conventional alloy during standard aging treatment so as to prevent sufficient aging hardening but the invention alloy having stable $\gamma'$-phase can be strengthened by an even greater degree under such a high strain. Therefore, when the invention alloy is used as materials of springs and the like for which A286 has been conventionally employed, performances can be further improved.

EXAMPLE 4

A286 is often used for tools for hot extrusion press of Cu or Cu alloy. Suitability of the invention alloy for this application was investigated. Containers for hot extrusion having a double structure of a shrinkage fitting type were used. Outer cylinders were made of SKT4 (0.55 C-0.3 Si-0.8 Mn-1.5 Ni-1.2 Cr-0.4 Mo-0.2 V-Balance of Fe), and inner cylinders made of the invention alloy and A286 were prepared. Then, comparison tests were conducted. Table 5 shows test compositions of an invention alloy No. 15 and a conventional alloy of A286 which were used for the inner cylinders.

Two types of small-sized containers of the double structure each of which comprised an outer cylinder having an outer diameter of 200 mm and an inner cylinder having an outer diameter of 100 mm and an inner diameter of 60 mm, both having a length of 200 mm, were manufactured of the invention alloy and the conventional alloy. With the containers, extrusion tests of pure copper billets heated at 950° C. were conducted by a press machine of 100 t. The inner cylinders were exposed to a high temperature of about 800° C. and a high pressure of about 500 N/mm$^2$, and hexagonal heat cracks were generated due to thermal stress. As a result, facial separation was caused, and the duration expired.

In the case of A286, generation of heat cracks on the inner peripheral surfaces was already observed when about 10,000 test pieces were formed. However, in the case of the invention alloy No. 15, slight generation of heat cracks was observed after about 15,000 test pieces were formed. It is obvious from this result that the invention alloy exhibits an excellent performance as tools for hot extrusion press.

TABLE 5

| | | CHEMICAL COMPOSITION (wt %) | | | | | | | | | | | | | | |
|---|---|---|---|---|---|---|---|---|---|---|---|---|---|---|---|---|
| | No. | C | Si | Mn | Ni | Cr | Mo | W | Al | Ti | Nb | Fe | B | Zr | Mg | Ca |
| INVENTION ALLOY | 15 | 0.17 | 0.66 | 1.65 | 25.7 | 13.2 | 0.47 | — | 1.24 | 2.92 | 0.32 | Bal. | 0.0044 | — | — | — |
| COMPARATIVE ALLOY | 32 | 0.06 | 0.45 | 1.01 | 25.2 | 14.4 | 1.28 | — | 0.22 | 0.23 | — | Bal. | 0.0045 | — | — | V:0.35 |

| | No. | Mo+ 0.5W | VALUE A | VALUE B | VALUE C | VALUE D |
|---|---|---|---|---|---|---|
| INVENTION ALLOY | 15 | 0.47 | 0.79 | 5.31 | 0.42 | 0.052 |
| COMPARATIVE ALLOY | 32 | 1.28 | 1.28 | 2.63 | 0.15 | 0.000 |

VALUE A = Nb + Mo + 0.5W
VALUE B = 1.81Al + Ti + 0.5Nb
VALUE C = 1.8A/(1.8Al + Ti + 0.5Nb)
VALUE D = 0.5N/(Ti + 0.5Nb)

EXAMPLE 5

Ingots of invention alloys, comparative alloys and conventional alloys (V57 and A286) were melted and cast in vacuum, and formed into bars having a diameter of 7.4 mm by hot forging and cold drawing. Table 6 shows chemical compositions of test samples. In this table, Nos. 16 and 17 are invention alloys, Nos. 24 to 26 are comparative alloys, and Nos. 33 and 34 are conventional alloys. Of the conventional alloys, No. 33 is an alloy equivalent to V57, and No. 34 is an alloy equivalent to A286.

TABLE 6

| | | CHEMICAL COMPOSITION (wt %) | | | | | | | | | | | | | | |
|---|---|---|---|---|---|---|---|---|---|---|---|---|---|---|---|---|
| | No. | C | Si | Mn | Ni | Cr | Mo | W | Al | Ti | Nb | Fe | B | Zr | Mg | Ca |
| INVENTION ALLOY | 16 | 0.01 | 0.11 | 0.31 | 26.3 | 13.3 | 0.48 | — | 1.10 | 3.10 | 0.37 | Bal. | 0.006 | — | — | — |
| | 17 | 0.03 | 0.40 | 0.15 | 27.3 | 11.4 | 0.81 | — | 0.72 | 2.83 | 0.41 | Bal. | — | 0.13 | — | — |
| COMPARATIVE ALLOY | 24 | 0.04 | 0.23 | 0.19 | 25.4 | 12.8 | — | — | 0.45 | 3.74 | — | Bal. | 0.004 | — | — | — |
| | 25 | 0.04 | 0.19 | 0.25 | 23.5 | 12.5 | — | — | 1.14 | 3.37 | — | Bal. | 0.005 | — | — | — |
| | 26 | 0.05 | 0.21 | 0.24 | 26.1 | 14.4 | 1.35 | — | 1.15 | 3.07 | 0.44 | Bal. | 0.005 | — | — | — |
| CONVENTIONAL ALLOY | 33 | 0.04 | 0.53 | 0.29 | 27.2 | 14.8 | 1.23 | — | 0.29 | 3.06 | — | Bal. | 0.004 | — | — | V:0.31 |
| | 34 | 0.04 | 0.17 | 0.12 | 26.1 | 15.1 | 1.24 | — | 0.31 | 2.15 | — | Bal. | 0.003 | — | — | V:0.29 |

| | No. | Mo+ 0.5W | VALUE A | VALUE B | VALUE C | VALUE D |
|---|---|---|---|---|---|---|
| INVENTION ALLOY | 16 | 0.48 | 0.85 | 5.27 | 0.38 | 0.056 |
| | 17 | 0.81 | 1.22 | 4.33 | 0.30 | 0.068 |
| COMPARATIVE ALLOY | 24 | 0.00 | 0.00 | 4.55 | 0.18 | 0.000 |
| | 25 | 0.00 | 0.00 | 5.42 | 0.38 | 0.000 |
| | 26 | 1.35 | 1.79 | 5.36 | 0.39 | 0.067 |
| CONVENTIONAL ALLOY | 33 | 1.23 | 1.23 | 3.58 | 0.15 | 0.000 |
| | 34 | 1.24 | 1.24 | 2.71 | 0.21 | 0.000 |

VALUE A = Nb + Mo + 0.5W
VALUE B = 1.8Al + Ti + 0.5Nb
VALUE C = 1.8Al/(1.8Al + Ti + 0.5Nb)
VALUE D = 0.5Nb/(Ti + 0.5Nb)

These bars were subjected to a solid solution heat treatment at 980° C. for one hour followed by water cooling, and thereafter subjected to a lubricative coating treatment. Then, the adhesiveness of coatings was investigated on the basis of separation conditions of the coatings and the coating weight per unit facial area in 90° bending tests of the bars. Further, the samples in this state were worked into pieces having a diameter of 7 mm and a length of 15 mm, and the oxidation resistances and structural stabilities were investigated. The test pieces were heated at 800° C. in the atmospheric air for 200 hours, and the structural stabilities were investigated on the basis of weight gains of oxidation before and after heating and by observation of cross-sectional micro-structures after heating.

Also, the bars covered with the lubricative coatings were shaped into hexagon-head bolts of M8 by cold drawing of 4% and cold heading and thread rolling. After heating the bolts at 730° C. for 16 hours, they were subjected to air-cooling aging treatment, and relaxation tests were performed. In the relaxation tests, both ends of each M8 bolt on which a nut was fitted were fixed on jigs in a tension tester and heated to 700° C. in a resistance heating furnace. After that, a load of 1350 kgf (35 kgf/mm$^2$ in terms of a stress in a smaller-diameter portion) was applied to the bolt, and the bolt in this state was controlled to keep the displacement constant. The load after 50 hours was read from the chart, and the axial tension maintaining ratio (the axial tension after 50 hours of load application/the initial load $\times$100) was derived. Table 7 shows evaluation results of the lubricative coating adhesiveness, the axial tension maintaining ratio, the oxidation weight gain and the structural stability. In Table 7, evaluation of the structural stability was shown by indicating, with a mark 0, the structure in which $\gamma'$-phase and carbide were precipitated in the matrix of $\gamma$-phase and indicating, with a mark x, the structure in which harmful phases such as $\eta$-phase and $\alpha$-phase were precipitated.

TABLE 7

| | No. | ADHESIVENESS OF LUBRICANT COATING: 90° C. BENDING TEST | ADHESIVENESS OF LUBRICANT COATING: COATING WEIGHT (g/m$^2$) | AXIAL TENSION MAINTAINING RATIO (%) | OXIDATION WEIGHT GAIN (mg/m$^2$) | STRUCTURAL STABILITY |
|---|---|---|---|---|---|---|
| INVENTION | 16 | NO SEPARATION | 7-9 | 58.1 | 0.31 | ○ |
| ALLOY | 17 | NO SEPARATION | 8-11 | 60.0 | 4.22 | ○ |
| COMPARA- | 24 | NO SEPARATION | 11-13 | 33.5 | 5.52 | x |
| TIVE | 25 | NO SEPARATION | 11-13 | 36.4 | 6.50 | x |
| ALLOY | 26 | SEPARATION | 1-7 | — | 0.51 | ○ |
| CONVEN- | 33 | NO SEPARATION | 9-11 | 30.4 | 0.65 | x |
| TIONAL ALLOY | 34 | NO SEPARATION | 9-11 | 31.5 | 0.44 | x |

As understood from Table 7, either of the invention alloys Nos. 16 and 17 is excellent in the lubricative coating adhesiveness, the axial tension maintaining ratio, the oxidation resistance and the structural stability, and exhibits favorable properties as heat resistant bolts.

In any of the comparative alloy No. 24 and the conventional alloys No. 33 (V57) and No. 34 (A286), the Al content is lower than the invention alloys, and the value C is too low. Consequently, $\eta$-phase is precipitated after long-time heating, thereby making the structure unstable and decreasing the axial tension maintaining ratio. Those alloys are inferior to the invention alloys in respect of oxidation resistance because of the low content of Al. Since the Ni content of the comparative alloy No. 25 is too low, oxidation resistance after long-time heating at 800° C. is lower than that of the invention alloys. $\gamma$-phase is partially transformed into $\alpha$-phase, thereby making the structure unstable and decreasing the axial tension maintaining ratio. Mo content of the comparative alloy No. 26 is higher than that of the invention alloys, and also, the Cr content is relatively higher, so that the lubricant coating adhesiveness is deteriorated. Because seizure occurred at the time of forming bolts of No. 26, working of test pieces was stopped, and relaxation tests were not performed.

According to the present invention, there can be provided an inexpensive $\gamma'$-precipitation strengthening Fe-base superalloy which is excellent in high-temperature strength and structural stability and used for heat resistant tools such as tools for hot extrusion press and hot forging dies, engine valves, gas turbine engine parts, various kinds of coil or sheet springs, heat resistant bolts and so forth.

What is claimed is:

1. An Fe-base superalloy essentially consisting of, by weight, up to 0.20% C, up to 1.0% Si, up to 2.0% Mn, more than 25% and less than 30% Ni, 10 to 15% Cr, one or both of not less than 0.05% and less than 1.0% Mo and not less than 0.05% and less than 2.0% W so that an amount of "Mo+0.5 W" is not less than 0.05 and less than 1.0, 0.7 to 2.0% Al , 2.5 to 4.0% Ti, 0.05 to 1.0% Nb, and the balance being substantially Fe except for impurities.

2. An Fe-base superalloy essentially consisting of, by weight, up to 0.15% C, up to 0.5% Si, up to 1.5% Mn, more than 25% and less than 30% Ni, not less than 10% and less than 13.5% Cr, one or both of not less than 0.05% and less than 1.0% Mo and not less than 0.05% and less than 2.0% W so that an amount of "Mo+0.5 W" is not less than 0.05 and less than 1.0, 0.7 to 2.0% Al, 2.5 to 4.0% Ti, 0.05 to 1.0% Nb, and the balance being substantially Fe except for impurities.

3. An Fe-base superalloy essentially consisting of, by weight, up to 0.10% C, up to 0.3% Si, up to 0.7% Mn, 25.5 to 28% Ni, not less than 12% and less than 13.5% Cr, one or both of 0.1 to 0.8% Mo and 0.1 to 1.6% W so that an amount of "Mo+0.5 W" is 0.2 to 0.8, 0.9 to 1.5% Al,2.7 to 3.6% Ti, 0.2 to 0.8% Nb, and the balance being substantially Fe except for impurities.

4. An Fe-base superalloy according to any one of claims 1 to 3, wherein the relationship of Nb, Mo and W satisfies the following formula:

$$0.55 \leqq Nb+Mo+0.5\ W \leqq 1.6.$$

5. An Fe-base superalloy according to any one of claims 1 to 3, wherein the relationship of Nb, Mo and W satisfies the following formula:

$$0.7 \leqq Nb+Mo+0.5\ W \leqq 1.35.$$

6. An Fe-base superalloy according to any one of claims 1 to 5, wherein the relationship of Al, Ti and Nb satisfies the following formula:

$$4.5 \leqq 1.8\ Al + Ti + 0.5\ Nb \leqq 6.0.$$

7. An Fe-base superalloy according to any one of claims 1 to 5, wherein the relationship of Al, Ti and Nb satisfies the following formula:

$$5.0 \leqq 1.8\ Al + Ti + 0.5\ Nb \leqq 5.5.$$

8. An Fe-base superalloy according to any one of claims 1 to 7, wherein the relationship of Al, Ti and Nb satisfies the following formula:

$$0.25 \leqq 1.8\ Al/(1.8\ Al + Ti + 0.5\ Nb) \leqq 0.60.$$

9. An Fe-base superalloy according to any one of claims 1 to 7, wherein the relationship of Al, Ti and Nb satisfies the following formula:

$$0.35 \leqq 1.8\ Al/(1.8\ Al + Ti + 0.5\ Nb) \leqq 0.45.$$

10. An Fe-base superalloy according to any one of claims 1 to 9, wherein the relationship of Ti and Nb satisfies the following formula:

$$0.02 \leqq 0.5\ Nb/(Ti + 0.5\ Nb) \leqq 0.15.$$

11. An Fe-base superalloy according to any one of claims 1 to 9, wherein the relationship of Ti and Nb satisfies the following formula:

$$0.04 \leqq 0.5\ Nb/(Ti + 0.5\ Nb) \leqq 0.13.$$

12. An Fe-base superalloy according to any one of claims 1 to 11, wherein Fe is partially substituted by one or both of up to 0.02% B and up to 0.2% Zr.

13. An Fe-base superalloy according to any one of claims 1 to 12, wherein Fe is partially substituted by one or both of up to 0.02% Mg and up to 0.02% Ca.

* * * * *